US006535825B1

(12) United States Patent
Okano

(10) Patent No.: US 6,535,825 B1
(45) Date of Patent: Mar. 18, 2003

(54) METHOD AND DEVICE FOR OBTAINING CALIBRATION DATA OF MECHANICAL PRESS, AND LOAD DISPLAY DEVICE FOR MECHANICAL PRESS

(75) Inventor: Shinji Okano, Kobe (JP)

(73) Assignee: Kabushiki Kaisha Kosmek, Hyogo (JP)

( * ) Notice: Subject to any disclaimer, the term of this patent is extended or adjusted under 35 U.S.C. 154(b) by 440 days.

(21) Appl. No.: 09/631,831

(22) Filed: Aug. 3, 2000

(30) Foreign Application Priority Data

Aug. 3, 1999 (JP) ..... 11-219503

(51) Int. Cl.[7] ..... G07L 1/00

(52) U.S. Cl. ..... 702/41; 702/41; 702/105; 702/33; 702/113; 702/114; 73/1.57; 73/12.07; 700/117; 700/206; 100/99

(58) Field of Search ..... 702/41, 105, 33, 702/114, 42, 43, 85, 94, 95, 97, 98, 113, 138, 140, 150, 152, 158, 166; 73/1.57, 12.07; 700/117, 206, 145, 160, 180; 100/99

(56) References Cited

U.S. PATENT DOCUMENTS

| | | | |
|---|---|---|---|
| 4,085,669 | A | 4/1978 | Yonezawa |
| 4,453,421 | A | 6/1984 | Umano |
| 4,823,687 | A | 4/1989 | Yonezawa et al. |
| 5,620,024 | A | 4/1997 | Yonezawa |
| 5,746,122 | A | 5/1998 | Gietz |
| 6,293,155 | B1 | 9/2001 | Babiel |

FOREIGN PATENT DOCUMENTS

| | | |
|---|---|---|
| EP | 1048942 | 2/2000 |
| JP | 50-38228 | 8/1975 |

*Primary Examiner*—John Barlow
*Assistant Examiner*—Meagan Walling
(74) *Attorney, Agent, or Firm*—Bacon & Thomas, PLLC

(57) ABSTRACT

When obtaining load displaying calibration data, first, a reference die height position (a) where a load (F) of a mechanical press (1) comes to minimum load value (Fa) is sought as well as a reference die height position (f) where the load (F) comes to maximum load value (Ff). Then a plurality of intermediate die height positions (b . . . e) are selected between these reference die height positions (a) and (f). Subsequently, a load is imposed on the mechanical press (1) at each of the die height positions (a . . . f) and a pressure sensor (33) senses peak oil pressures (Pa . . . Pf) corresponding to the respective die height positions (a . . . f). Thereafter, relative relationships between load values (Fa . . . Ff) corresponding to the die height positions (a . . . f) and the peak oil pressures (Pa . . . Pf) are obtained as a characteristic curve (B).

6 Claims, 4 Drawing Sheets

METHOD AND DEVICE FOR OBTAINING CALIBRATION DATA OF MECHANICAL PRESS, AND LOAD DISPLAY DEVICE FOR MECHANICAL PRESS

BACKGROUND OF THE INVENTION

1. Field of the Invention

The present invention relates to a method and a device for obtaining calibration data used to display loads of a mechanical press, and it concerns a device for calculating loads of the mechanical press based on the obtained calibration data and displaying the calculated values.

2. Explanation of Earlier Technology

A working operation of a mechanical press prefers precisely measuring loads during a press working so as to determine adequate working conditions. In order to measure the loads, a conventional technique has adhered a strain gauge to a pressure receiving structural portion such as a frame and a connecting rod of the mechanical press and has detected strain of the pressure receiving structural portion. Then it has converted the detected strain to loads.

However, since the measured values of the strain vary depending on the positions where the strain gauge is adhered, the conventional technique had to search a proper position for adhering the strain gauge and calibrate the measured values. This made it troublesome to measure loads of a mechanical press and besides caused a large measurement error.

In order to solve the problems, the present inventor proposed a method for measuring loads by utilizing an overload absorbing hydraulic chamber provided in the mechanical press (see Japanese Patent Appln. No. 11-121756), prior to the present invention.

The earlier proposal preliminarily inputs to a microcomputer, corresponding relationships between loads of the mechanical press and oil pressures of the hydraulic chamber as load displaying calibration data. It detects maximum oil pressure of the hydraulic chamber when conducting a press working and measures loads during the press working based on the maximum oil pressure and the calibration data.

In order to obtain the calibration data, a below-mentioned method is considered.

The method comprises actually imposing on a mechanical press a large number of loads extending from no load to maximum load and measuring a largeness of each load by a load cell, a measuring hydraulic cylinder or the like as well as a peak pressure of the hydraulic chamber when each load is imposed, to thereby obtain relative relationships between the loads and the oil pressures.

However, the above-mentioned method has to prepare a special load measuring instrument such as the load cell and the measuring hydraulic cylinder and besides requires high expertise and long experience for handling such a load measuring instrument. Additionally, it needs to subject the measured data to a troublesome calibration work. Therefore, it takes lots of labor to obtain calibration data peculiar to every mechanical press. On this point this method still had to be improved.

SUMMARY OF THE INVENTION

The present invention has a first object to provide a method which makes it possible to easily obtain calibration data peculiar to every mechanical press. It has a second object to provide a device which makes it possible to readily obtain the calibration data. Further, it has a third object to provide a device which can display loads of a mechanical press based on the obtained calibration data with a high accuracy.

In order to accomplish the first object, an invention of claim 1 has constructed a method for obtaining calibration data of a mechanical press in the following manner, for example, as shown in FIGS. 1 to 3 as well as in FIGS. 4(A) and 4(B).

The method obtains load displaying calibration data by utilizing the fact that a load (F) of the mechanical press 1 is proportional to strain of the mechanical press 1 and a die height (H) set through a die height adjusting mechanism 20.

It comprises the steps of:

seeking at least two reference die height positions (a)(f) where the load (F) comes to a small load value (Fa) and a large load value (Ff);

selecting intermediate die height positions (b,c,d,e) corresponding to a plurality of intervening load values (Fb,Fc,Fd,Fe) between the small load value (Fa) and the large load value (Ff);

sensing values (Pa,Pb,Pc,Pd,Pe,Pf) correlative to strain and corresponding to the respective die height positions (a,b,c,d,e,f) by imposing a load on the mechanical press 1 at each of the die height positions (a,b,c,d,e,f); and obtaining relative relationships between the load values (Fa,Fb,Fc,Fd,Fe,Ff) corresponding to the plurality of die height positions (a,b,c,d,e,f) and the sensed values correlative to strain (Pa,Pb,Pc,Pd,Pe,Pf) as load displaying calibration data (FP).

The invention of claim 1 functions in the following manner, for example, as shown in FIGS. 1 to 3 as well as in FIGS. 4(A) and 4(B).

When obtaining calibration data corresponding to a characteristic curve (B) in FIG. 4(B), first, the die height adjusting mechanism 20 is adjusted to impose a load (F) on the mechanical press 1. Then it seeks a reference die height position (a) where the load (F) comes to a small load value (here minimum load value) (Fa) as well as a reference die height position (f) where the load (F) comes to a large load value (here maximum load value) (Ff).

Next, it selects a plurality of intermediate die height positions (b . . . e) at a predetermined interval between the reference die height positions (a) and (f). In this case, as shown by a straight line (A) in FIG. 4(A), owing to the fact that the load (F) of the mechanical press 1 is proportional to the die height (H) set through the die height adjusting mechanism 20, a plurality of intervening load values (Fb . . . Fe) between the small load value (Fa) and the large load value (Ff) also linearly correspond to the selected intermediate die height positions (b . . . e). Therefore, the intervening load values (Fb . . . Fe) can be calculated based on the intermediate die height positions (b . . . e) and the straight line (A). This dispenses with a necessity of actually measuring them.

Subsequently, through a sensing means 33, it senses values (Pa . . . Pf) correlative to strain (here oil pressures) and corresponding to the respective die height positions (a . . . f) by imposing a load on the mechanical press 1 at each of the die height positions (a . . . f). Then it obtains relative relationships between the load values (Fa . . . Ff) corresponding to the die height positions (a . . . f) and the sensed values correlative to strain (Pa . . . Pf) as the characteristic curve (B) (calibration data (FP)).

As mentioned above, the invention of claim 1 does not have to use any special load measuring instrument such as the load cell and the measuring hydraulic cylinder when obtaining the calibration data. This dispenses with not only high expertise and long experience but also the troublesome calibration work.

Further, the intervening load values between the small load value and the large load value can be calculated based on the fact that they linearly correspond to the intermediate die height positions and need not be actually measured. This can remove the measuring work of the intervening load values.

In consequence, it can readily obtain calibration data peculiar to every mechanical press.

An invention of claim 2, in the invention as set forth in claim 1, imposes a load on the mechanical press 1 at each of the die height positions (a,b,c,d,e,f) and senses a peak oil pressure of an overload absorbing hydraulic chamber 13 provided in the mechanical press 1 by an oil pressure sensing means 33. It takes the thus sensed peak oil pressures (Pa,Pb,Pc,Pd,Pe,Pf) as the value correlative to strain.

The invention of claim 2 can obtain the calibration data by utilizing the overload absorbing hydraulic chamber provided in the mechanical press and therefore need not provide a device dedicated for obtaining the calibration data anew. In consequence, it can obtain the calibration data easily with a simple construction.

In order to seek the reference die height positions (a)(f), an invention of claim 3, in the invention as set forth in claim 2, preliminarily acquires values of reference peak oil pressures (Pa)(Pf) corresponding to the small load value (Fa) and the large load value (Ff), and it takes die height positions when the oil pressure sensing means 33 has sensed the reference peak oil pressures (Pa)(Pf) with loads imposed on the mechanical press 1, as the reference die height positions (a)(f).

The invention of claim 3 can seek two reference die height positions by using the oil pressure sensing means of the overload absorbing hydraulic chamber provided in the mechanical press. Therefore, it can easily seek these positions with a simple construction.

In order to accomplish the second object, an invention of claim 4 has constructed a device for obtaining calibration data of a mechanical press in the following manner, for example, as shown in FIGS. 1 to 3 as well as in FIGS. 4(A) and 4(B).

The device obtains load displaying calibration data by utilizing the fact that a load (F) of the mechanical press 1 is proportional to strain of the mechanical press 1 and a die height (H) set through a die height adjusting mechanism 20. Further, at least two reference die height positions (a)(f) where the load (F) comes to a small load value (Fa) and a large load value (Ff) are sought, and intermediate die height positions (b,c,d,e) corresponding to a plurality of intervening load values (Fb,Fc,Fd,Fe) between the small load value (Fa) and the large load value (Ff) are selected.

The device comprises a sensing means 33 which senses values (Pa,Pb,Pc,Pd,Pe,Pf) correlative to strain and corresponding to the plurality of die height positions (a,b,c,d,e,f), a data inputting means 31, and a calibration data storing means 40.

The calibration data storing means 40 stores relative relationships between the load values (Fa,Fb,Fc,Fd,Fe,Ff) corresponding to the die height positions (a,b,c,d,e,f) and the sensed values correlative to strain (Pa,Pb,Pc,Pd,Pe,Pf) as the load displaying calibration data (FP).

The invention of claim 4 embodies the method for obtaining calibration data as set forth in claim 1 and presents substantially the same function and effect as those of claim 1.

More specifically, it does not have to use any special load measuring instrument such as the load cell and the measuring hydraulic cylinder when obtaining the calibration data. This dispenses with not only high expertise and long experience but also the troublesome calibration work.

Besides, the plurality of intervening load values between the small load value and the large load value can be calculated based on the fact that they linearly correspond to the intermediate die height positions and need not be actually measured. This can remove the measuring work of these intervening load values.

In consequence, it can readily obtain calibration data peculiar to every mechanical press.

An invention of claim 5, in the invention as set forth in claim 4, imposes a load on the mechanical press 1 at each of the die height positions (a,b,c,d,e,f) and senses a peak oil pressure of an overload absorbing hydraulic chamber 13 provided in the mechanical press 1 by the sensing means 33. It takes the thus sensed peak oil pressures (Pa,Pb,Pc,Pd,Pe, Pf) as the values correlative to strain.

The invention of claim 5 can obtain the calibration data by utilizing the overload absorbing hydraulic chamber provided in the mechanical press. This dispenses with a necessity of providing a device dedicated for obtaining the calibration data anew. In consequence, it can easily obtain the calibration data with a simple structure.

In order to accomplish the third object, an invention of claim 6 has constructed a device for displaying loads of a mechanical press in the following manner, for example, as shown in FIGS. 1 to 3 as well as in FIGS. 4(A) and 4(B).

It comprises an overload absorbing hydraulic chamber 13 provided within a slide 4 of the mechanical press 1 and a die height adjusting mechanism 20 arranged in the slide 4, an oil pressure sensing means 33 being connected to the hydraulic chamber 13.

By utilizing the fact that a load (F) of the mechanical press 1 is proportional to a pressure (P) of the hydraulic chamber 13 and a die height (H) set through the die height adjusting mechanism 20, it obtains a relative relationship between the load (F) and the pressure (P) of the hydraulic chamber 13 as load displaying calibration data (FP) and preliminarily inputs the calibration data (FP) to a calculating device 35.

Based on maximum oil pressure ($P_{MAX}$) sensed by the oil pressure sensing means 33 during a press working and the calibration data (FP), the calculating device 35 calculates the load (F) of the mechanical press 1 and the calculated load (F) is displayed by a display 36.

The calculating device 35 comprises a calibration data storing means 40 which stores the calibration data (FP), storing means 44,45 which store minimum oil pressure ($P_{MIN}$) sensed by the oil pressure sensing means 33 and the maximum oil pressure ($P_{MAX}$), respectively, a program command means 46 which commands a correcting calculation and a load calculation according to predetermined procedures, a preload pressure comparing means 47 which monitors variation of the minimum oil pressure ($P_{MIN}$), a correcting means 48 which corrects the calibration data (FP) in accordance with the variation, and a calculating means 49 which calculates the load (F) from the corrected calibration data (FP) and the maximum oil pressure ($P_{MAX}$).

The invention of claim 6 corrects the calibration data in accordance with the variation of the minimum oil pressure within the hydraulic chamber. Therefore, it can precisely calculate an actual load during a press working by resorting to the corrected calibration data, which results in the possibility of displaying the actual load during the press working with a high accuracy.

BRIEF DESCRIPTION OF THE DRAWINGS

FIG. 1 is a system diagram of a load display device for a mechanical press;

FIG. 2 is a block diagram corresponding to functions of a microcomputer provided in the load display device;

FIG. 3 is a flow chart of the load display device;

FIG. 4(A) is a graph showing a relationship between a load of the mechanical press and a die height; and FIG. 4(B) is a graph showing a relationship between the load and an oil pressure.

DESCRIPTION OF THE PREFERRED EMBODIMENTS

Figure 1:
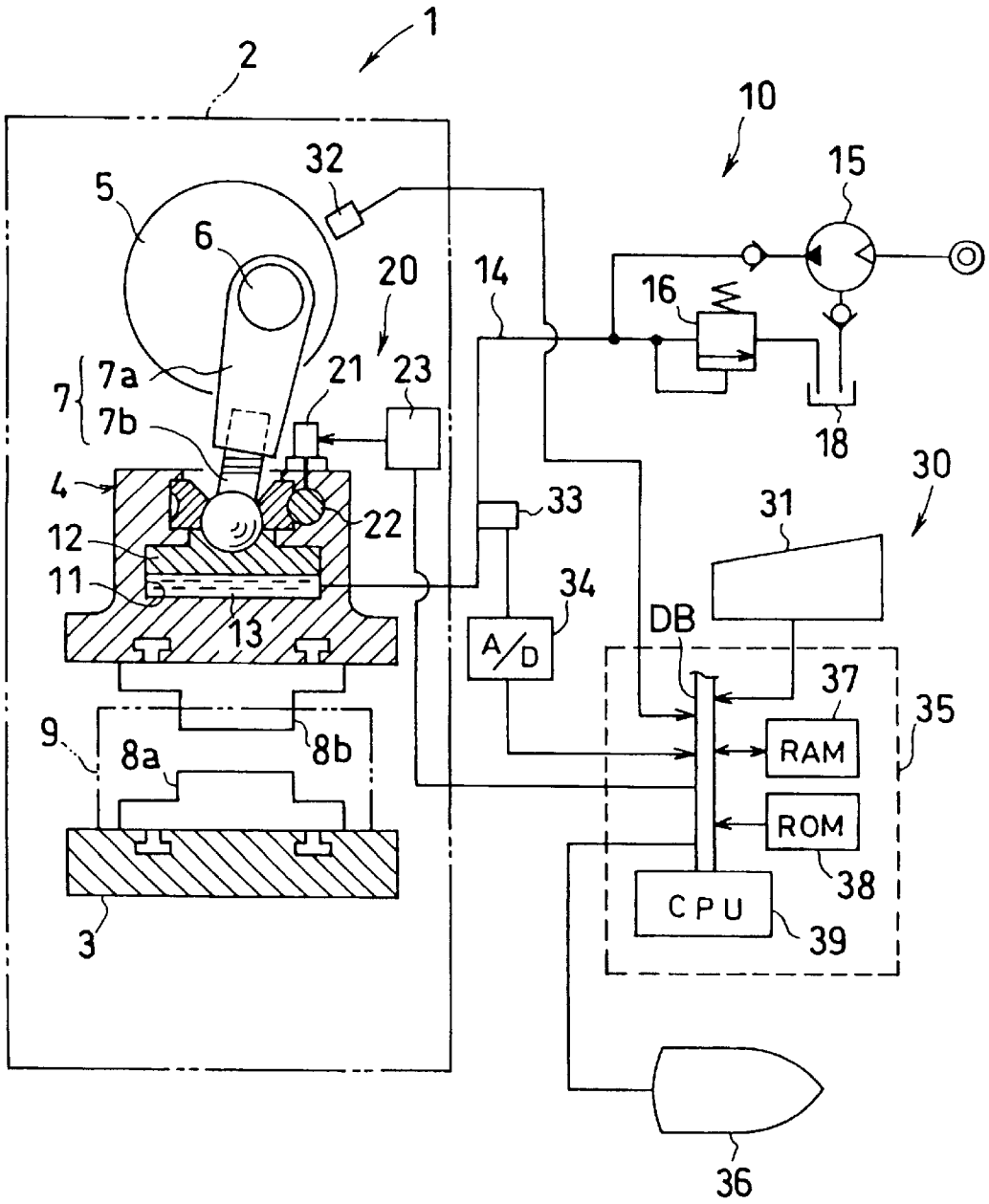
FIGS. 1 to 3, FIG. 4(A) and FIG. 4(B) show an embodiment of the present invention.
Figure 2:
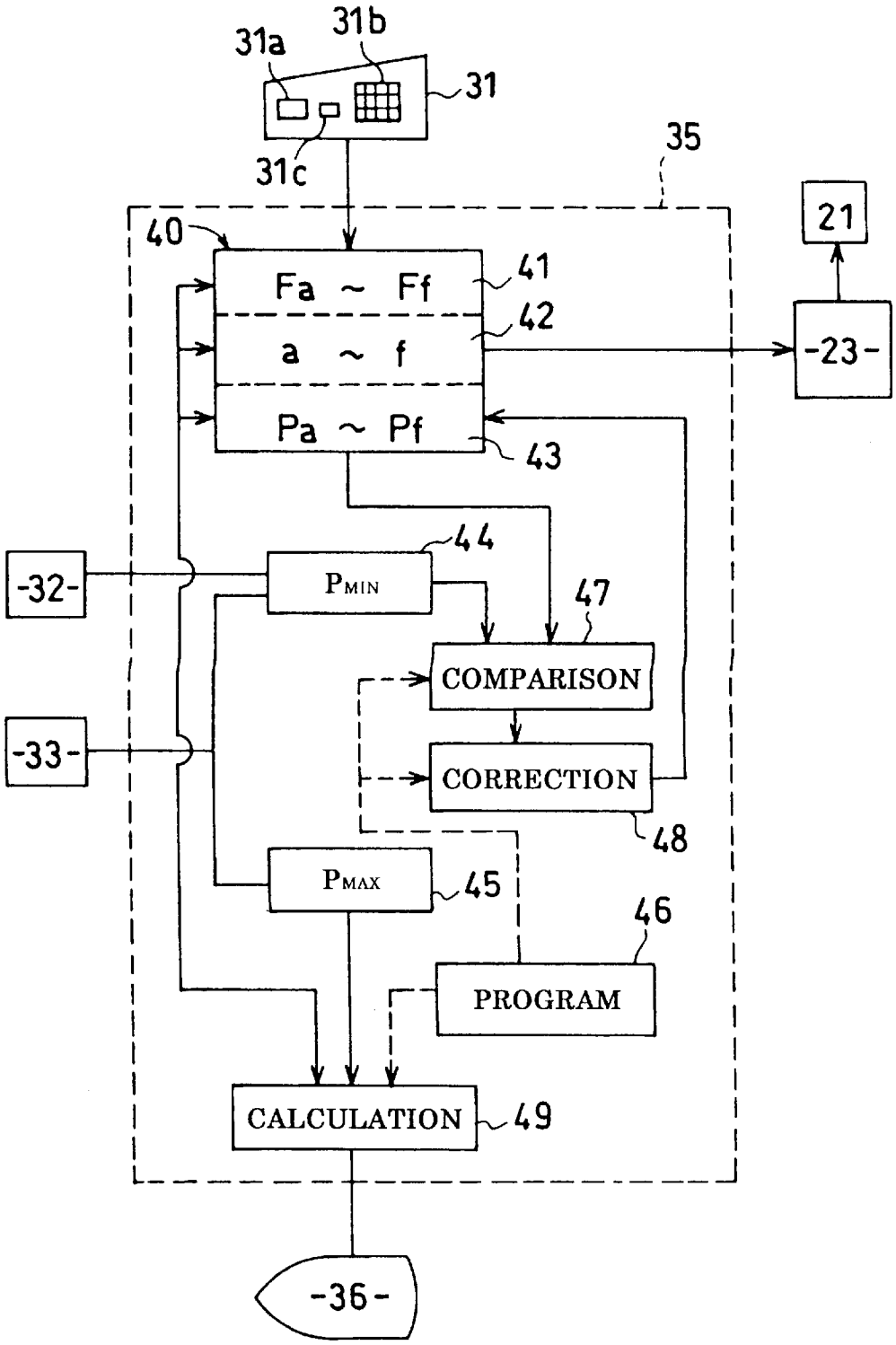
Figure 3:
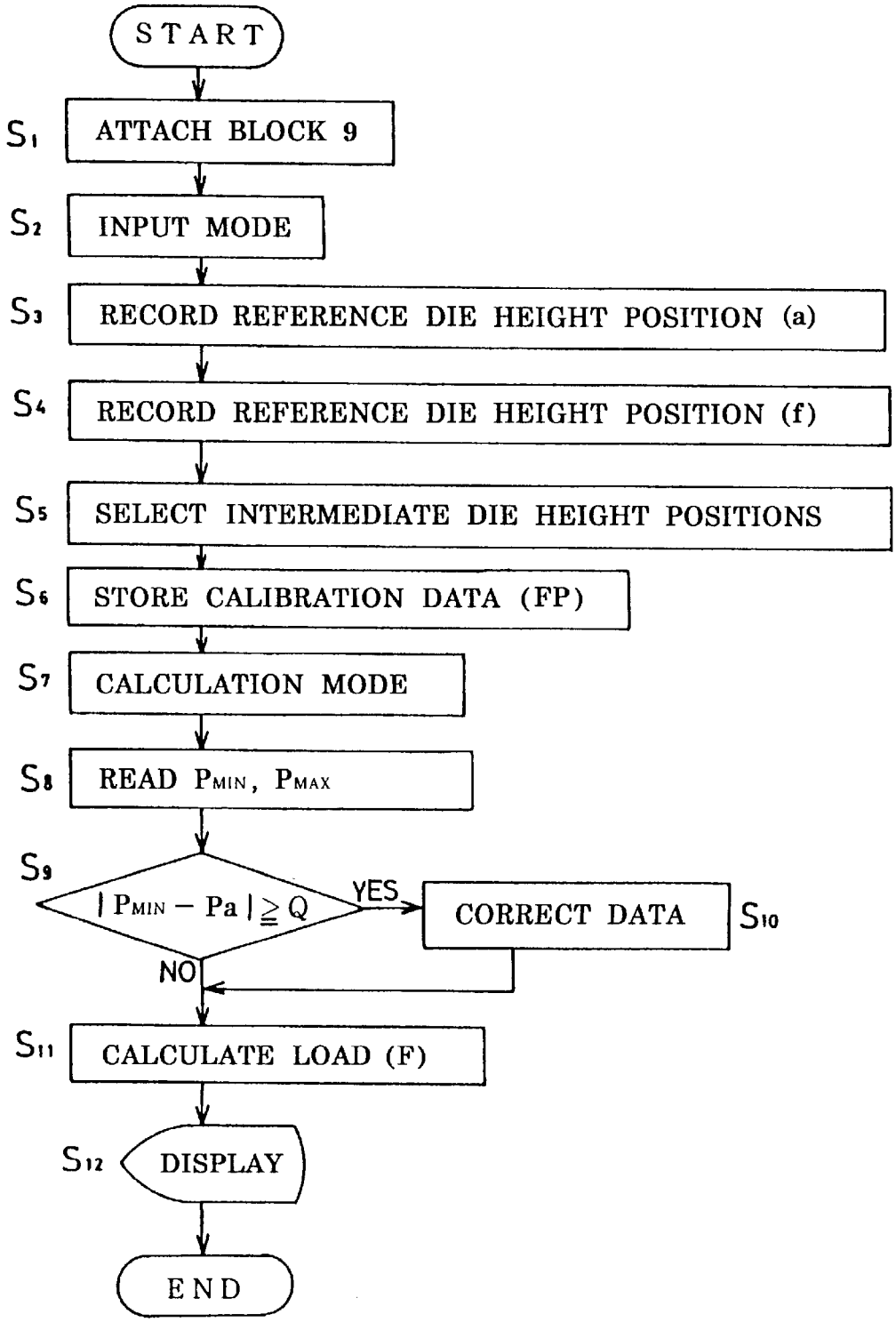
Figure 4:
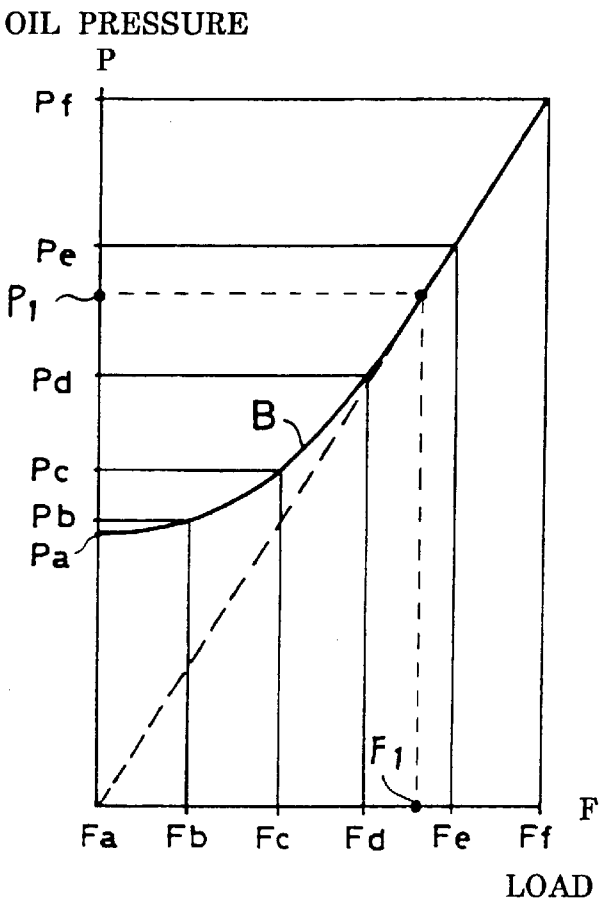
Figure 4:
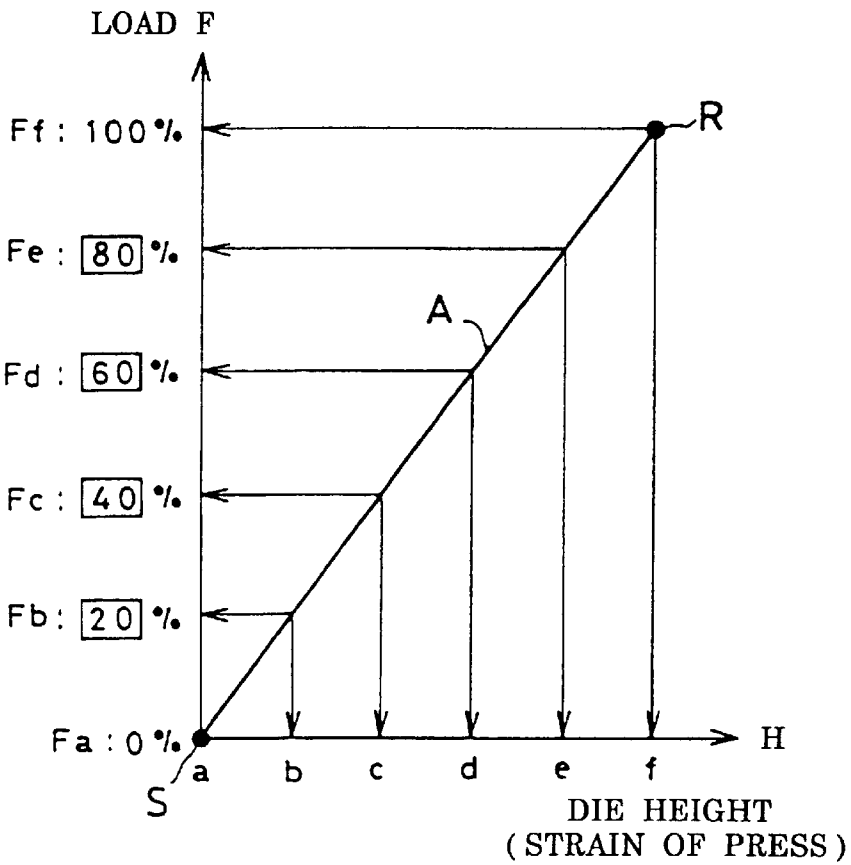

Hereafter, an embodiment of the present invention is explained by relying on FIGS. 1 to 3 as well as on FIGS. 4(A) and 4(B). First, explanation is given for a whole structure of a crank-type mechanical press 1 according to the present invention, based on FIG. 1.

The mechanical press 1 comprises a bolster 3 fixedly provided at a lower portion of a frame 2, a slide 4 vertically movably provided upwards of the bolster 3, a flywheel 5 rotatably provided upwards of the slide 4 and driven by a main electric motor not shown, a connecting rod 7 connected to an eccentric shaft 6 of the flywheel 5 and vertically moving the slide 4, a lower die 8*a* and an upper die 8*b* fixed to an upper surface of the bolster 3 and a lower surface of the slide 4, respectively, an overload protector 10, a die height adjusting mechanism 20 which adjusts a die height by extending and contracting the connecting rod 7, and a load display device 30 which displays loads during a press working.

The overload protector 10 comprises a cylinder bore 11 formed within the slide 4, a piston 12 inserted into the cylinder bore 11, an overload absorbing hydraulic chamber 13 formed downwards of the piston 12, a pneumatic and hydraulic booster pump 15 connected to the hydraulic chamber 13 via an oil passage 14, an overload protecting valve 16 arranged in parallel with the booster pump 15, a pressure compensating valve not shown, and an oil reservoir 18. The booster pump 15 supplies to the hydraulic chamber 13 pressurized oil of a set charging pressure (for example, a pressure of about 10 MPa).

And a press force acting on the connecting rod 7 is transmitted to a work (not shown) supplied between the lower die 8*a* and the upper die 8*b*, through the pressurized oil within the hydraulic chamber 13 and a bottom portion of the slide 4, thereby subjecting the work to a press working.

When overload has acted on the slide 4 during the press working for any reason and the pressure of the hydraulic chamber 13 has exceeded a set overload pressure (for example, a pressure of about 23 MPa), the overload protecting valve 16 performs a relief operation to discharge the pressurized oil of the hydraulic chamber 13 to the oil reservoir 18, thereby preventing the overload.

Further, when the inner pressure of the hydraulic chamber 13 very slowly increases to have exceeded a set compensating pressure (a little higher than the set charging pressure and, for example, a pressure of about 12 MPa), the pressure compensating valve (not shown) effects a relief operation to discharge the pressurized oil by an amount corresponding to the very slow pressure increase, to the oil reservoir 18. This retains the inner pressure of the hydraulic chamber 13 within a predetermined range and prevents a misoperation of the overload protecting valve 16.

The die height adjusting mechanism 20 comprises a normally and reversely rotatable electric motor (actuator) 21, a gear transmission mechanism 22 driven by the electric motor 21, and a driving circuit 23 for controlling the electric motor 21. The electric motor 21 extends and contracts the connecting rod 7 via the gear transmission mechanism 22 to adjust the die height. The connecting rod 7 comprises an upper half portion 7*a* and a lower half portion 7*b* engaged with each other in screw-thread fitting.

The load display device 30 comprises a data inputting means 31 for inputting various sorts of data, an angle sensor 32 for sensing a crank angle of the mechanical press 1, a pressure sensor (oil pressure sensing means) 33 of strain-gauge type connected to the oil passage 14, a converter 34 which makes an A/D conversion of an oil pressure signal of the pressure sensor 33, a calculating device 35 which calculates loads of the mechanical press 1 and the like based on the various sorts of data inputted by the data inputting means 31 and input signals from the sensors 32,33, and a display 36 which displays the calculated results.

The calculating device 35 is composed of a microcomputer and comprises a RAM 37 which stores an oil pressure (P) sensed by the pressure sensor 33, calibration data to be mentioned later, and the like, a ROM 38 which stores programs for performing a correcting calculation and a load calculation to be mentioned later, and a CPU 39 which effects various kinds of calculations based on the programs. It gives and takes various sorts of signals through a data bus (DB).

Next, explanation is given for functions of the calculating device 35 with reference to FIG. 2. FIG. 2 is a block diagram, which shows the various functions of the calculating device 35, as means, respectively.

The calculating device 35 comprises a calibration data storing means 40 which stores calibration data inputted by the inputting means 31, a minimum oil pressure storing means 44 which temporarily stores a preload pressure (minimum oil pressure when the pressurized oil has been charged) ($P_{MIN}$) sensed by the pressure sensor 33 when the crank angle comes to the vicinity of an upper dead center, a maximum oil pressure storing means 45 which temporarily stores maximum oil pressure ($P_{MAX}$) sensed by the pressure sensor 33 during a press working, a program command means 46 which commands a correcting calculation and a load calculation to be mentioned later, in accordance with predetermined procedures, a preload pressure comparing means 47 which monitors variation of the preload pressure ($P_{MIN}$), a correcting means 48 which corrects the calibration data according to the variation, and a calculating means 49 which calculates loads during the press working from the corrected calibration data and the maximum oil pressure ($P_{MAX}$). The calculated loads (F) are displayed by the display 36 one after another with a high accuracy.

The calibration data storing means 40 comprises a load storing means 41 which stores load values (Fa . . . Ff) corresponding to die height positions (a . . . f) set through the die height adjusting mechanism 20, a die height position storing means 42 which stores the die height positions (a . . . f), and a measured value storing means 43 which stores peak oil pressures (values correlative to strain) (Pa . . . Pf) corresponding to the respective die height positions (a . . . f). It stores calibration data to be mentioned later, as a data map.

The die height position storing means 42 is not an essential constituent and therefore may be omitted.

Then explanation is given for a method of obtaining the calibration data by relying on FIG. 3, FIG. 4(A) and FIG. 4(B) with reference to FIGS. 1 and 2. FIG. 3 is a flow chart indicating procedures for obtaining calibration data of the mechanical press 1 and those for acquiring loads during a press working based on the obtained calibration data. FIG. 4(A) is a graph which shows a relationship between a load (F) of the mechanical press 1 and a die height (H). FIG. 4(B) is a graph which shows a relationship between the load (F) and the oil pressure (P).

In FIG. 4(A) the value of the die height (H) is shown to decrease from the die height position (a) toward the die height position (f).

Generally, when a load (in other words, a reaction force of a press force) has acted on the mechanical press 1, the frame 2 of the mechanical press 1 substantially linearly strains between no load and maximum load. The strain linearly corresponds to the die height positions (a . . . f) set through the die height adjusting mechanism 20. The present invention obtains load displaying calibration data by utilizing this fact.

To briefly explain it, first, a corresponding relationship between the load (tonnage) (F) of the mechanical press 1 and the die height (H) is sought at steps ($S_1$) to ($S_5$) in FIG. 3. Then at step ($S_6$) in FIG. 3, relative relationships between load values (Fa . . . Ff) corresponding to the die height positions (a . . . f) and the oil pressure (P) are obtained as calibration data (FP).

Speaking it in more detail, at the step ($S_1$), a block 9 which hardly strains is attached between the bolster 3 and the slide 4 of the mechanical press 1 (see FIG. 1).

At the step ($S_2$), a mode selection key 31*a* of the inputting means 31 selects a data input mode.

At the step ($S_3$), the die height adjusting mechanism 20 is adjusted so that the load (F) of the mechanical press 1 comes to minimum load value (a small load value) (Fa) of about 0% . A die height position (a) at that time is recorded.

Concretely, the die height adjusting mechanism 20 is adjusted so that a peak pressure sensed by the pressure sensor 33 with a light load imposed on the mechanical press 1, increases slightly over a preload pressure. A die height position (a) at that time is recorded. The value of the pressure increase falls within a range of, for example, about 0.3 to 0.5 MPa.

At the step ($S_4$), the die height adjusting mechanism 20 is adjusted so that the load (F) of the mechanical press 1 comes to maximum load value (a large load value) (Ff) of 100%. A die height position (f) at that time is recorded.

Concretely, a reference oil pressure (Pf) within the hydraulic chamber 13 when the load (F) of the mechanical press 1 is 100% is preliminarily gained by a manual calculation. Speaking it in more detail, the reference oil pressure (Pf)=nominal capacity (nominal tonnage) of the mechanical press 1÷sectional area of the cylinder bore 11. The reference oil pressure (Pf) can be automatically calculated by inputting a nominal tonnage of the mechanical press 1 and a diameter of the cylinder bore 11 instead of the manual calculation.

And the die height adjusting mechanism 20 is adjusted so that a peak pressure sensed by the pressure sensor 33 with a load imposed on the mechanical press 1 becomes equal to the reference peak oil pressure (Pf). A die height position (f) at that time is recorded.

At the step ($S_5$), a plurality of intermediate die height positions (b . . . e) are selected between the two reference die height positions (a) and (f).

Concretely speaking, in the case where the above selection is made by resorting to a handwritten graph, first, as shown in FIG. 4(A), a first point (S) where the load (F) is the minimum load value (Fa) and the die height (H) is the reference die height position (a) is drawn as well as a second point (R) where the load (F) is the maximum load value (Ff) and the die height (H) is the reference die height position (f). These points (S) and (R) are connected to each other with a straight line (A). Next, a plurality of intermediate die height positions (b . . . e) are selected by a desired pitch between the two reference die height positions (a) and (f). In this example, the intermediate die height positions (b . . . e) are selected so that a plurality of intervening loads (Fb . . . Fe) between the minimum load value (Fa) and the maximum load value (Ff) are separated from each other by a pitch of 20%.

The intermediate die height positions (b . . . e) can be automatically outputted by using the calculating means 49 instead of the manual selection.

At the step ($S_6$), the calibration data storing means 40 stores a relative relationship between the load (F) and the oil pressure (P) as calibration data (FP).

Speaking it in more detail, first, the mode selection key 31*a* is switched over to a setting mode. At that state, an operation key 31*b* sets measuring points which correspond to the die height positions (a . . . f), in order. Next, the die height adjusting mechanism 20 is adjusted so that the die height (H) meets the respective die height positions (a . . . f) corresponding to the measuring points. A load is imposed on the mechanical press 1 at each of the die height positions (a . . . f) and the pressure sensor 33 senses respective peak oil pressures (Pa . . . Pf) at that time. Each time it senses, by pushing an input key 31*c*of the inputting means 31, the respective die height positions (a . . . f) are stored in the die height position storing means 42 and the peak oil pressures (Pa . . . Pf) corresponding to the respective die height positions (a . . . f) are stored in the measured value storing means 43.

It is expected that the calibration data (FP) which shows the relative relationship between the load (F) and the oil pressure (P) comes to be like a characteristic curve (B) in FIG. 4(B).

When actually conducting a press working, the lower die 8*a* and the upper die 8*b* are attached to the mechanical press 1 in place of the block 9. And the load (F) of the mechanical press 1 is calculated based on the calibration data (FP) stored in the calibration data storing means 40 and maximum oil pressure ($P_{MAX}$) sensed during the press working. The procedures are explained by relying on FIG. 3 with reference to FIGS. 1 and 2.

As shown at step ($S_7$), the mode selection key 31*a* is switched over to a calculation mode and the mechanical press 1 performs the press working.

At step (S8), the preload pressure ($P_{MIN}$) of the minimum oil pressure sensed by the pressure sensor 33 and the maximum oil pressure ($P_{MAX}$) during the press working are read and stored in the minimum oil pressure storing means 44 and the maximum oil pressure storing means 45, respectively.

By the way, the preload pressure ($P_{MIN}$) within the hydraulic chamber 13 subtly varies per stroke of the mechanical press 1 due to change of the atmospheric temperature, increase of oil temperature caused by the press working, and the like. This varies the maximum oil pressure ($P_{MAX}$) even if the largeness of the load (F) is identical. In consequence, it is necessary to correct the calibration data (FP) by taking the variation of the preload pressure ($P_{MIN}$) into consideration.

Then at step ($S_9$), in order to monitor the variation of the preload pressure ($P_{MIN}$), an actually sensed preload pressure ($P_{MIN}$) is compared with the minimum peak oil pressure (Pa) included in the calibration data (FP). If an absolute value of the difference is not less than a set value (Q), the calibration data (FP) is corrected at step ($S_{10}$). On the other hand, if it is less than the set value (Q), the processing proceeds to step ($S_{11}$). The correcting calculation of the calibration data (FP) at the step ($S_{10}$) is effected based on a shape of the characteristic curve (B) in FIG. 4(B).

At the step ($S_{11}$), a load (F) of the mechanical press 1 is calculated from maximum oil pressure ($P_{MAX}$) sensed during a press working and the calibration data (FP) (including the corrected calibration data). More concretely speaking, as shown in FIG. 4(B), when the sensed maximum oil pressure ($P_{MAX}$) is ($P_1$), the load (F) is calculated out as ($F_1$).

Since the calibration data (FP) is a discontinuous data map, the method of least squares and various interpolation methods are employed for calculating the load (F) of the mechanical press 1 at the step ($S_{11}$).

At step ($S_{12}$), the display 36 displays the load (F) during the press working of the calculated result.

The foregoing embodiment can be modified as follows.

When acquiring a load data corresponding to the straight line (A) in FIG. 4(A), the above embodiment has sought two reference die height positions (a)(f) corresponding to the reference small load value (Fa) and the reference large load value (Ff). Either of these reference load values and die height positions are not limited to two ones but may be at least three ones. The reference small load value (Fa) and the reference large load value (Ff) are not limited to 0% and 100% respectively. For example, they may be 10% and 90%, respectively. Further, the reference small load value (Fa) and the reference large load value (Ff) may be searched by a load cell, a strain sensor or the like instead of the pressure sensor 33.

When obtaining the calibration data (FP) corresponding to the characteristic curve (B) in FIG. 4(B), a relative relationship between the load (F) and strain of the frame 2 (or strain of the connecting rod 7) may be sought instead of the relative relationship between the load (F) and the oil pressure (P). In this case, the load cell, a strain gauge or the like may be employed as the sensing means instead of the exemplified pressure sensor 33.

The calibration data (FP) (characteristic curve (B)) is not limited to a single one as exemplified. Preferably, it is provided in plural number for each of predetermined preload pressures.

Additionally, when displaying the load (F) based on the inputted calibration data (FP), not only the method of least squares but also various interpolation methods and a data table may be employed.

Although the step ($S_3$) and the step ($S_4$) are preferably taken in the exemplified order so as to retain the measurement accuracy, they may be taken in reversed order. Speaking it in more detail, the above embodiment seeks the reference die height position (f) corresponding to the maximum load value (Ff) after having sought the reference die height position (a) corresponding to the minimum load value (Fa). Instead of this order, the reference die height position (a) corresponding to the minimum load value (Fa) may be sought after having sought the reference die height position (f) corresponding to the maximum load value (Ff).

The means for sensing the crank angle of the mechanical press 1 may be a limit switch, a proximity switch or the like instead of the exemplified angle sensor 32.

The means for sensing the pressure of the pressurized oil within the hydraulic chamber 13 may be a pressure sensor of electrical-capacitance type, a pressure sensor of electromagnetic-induction type or the like instead of the exemplified pressure sensor 33 of strain-gauge type.

The actuator for the die height adjusting mechanism 20 may be a hydraulic, a pneumatic or the like actuator instead of the exemplified electric motor 21.

The mechanical press 1 to which the present invention is applied may be a knuckle-type, a link-type, or the like one instead of the exemplified crank-type one.

What is claimed is:

1. A method for obtaining calibration data of a mechanical press by utilizing the fact that a load (F) of the mechanical press (1) is proportional to strain of the mechanical press (1) and a die height (H) set through a die height adjusting mechanism (20), the load (F) having a plurality of load values (Fa,Fb,Fc,Fd,Fe,Ff) and the die height (H) having a plurality of die height positions (a,b,c,d,e,f), the method comprising the steps of:

seeking at least two reference die height positions (a)(f) where the load (F) comes to a small load value (Fa) and a large load value (Ff);

selecting intermediate die height positions (b,c,d,e) corresponding to a plurality of intervening load values (Fb,Fc,Fd,Fe) between the small load value (Fa) and the large load value (Ff);

sensing values (Pa,Pb,Pc,Pd,Pe,Pf) correlative to strain and corresponding to the respective die height positions (a,b,c,d,e,f) by imposing a load on the mechanical press (1) at each of the die height positions (a,b,c,d,e,f); and obtaining relative relationships between the load values (Fa,Fb,Fc,Fd,Fe,Ff) corresponding to the plurality of die height positions (a,b,c,d,e,f) and the sensed values correlative to strain (Pa,Pb,Pc,Pd,Pe,Pf) as load displaying calibration data (FP).

2. The method for obtaining calibration data of a mechanical press as set forth in claim 1, wherein the mechanical press (1) is provided with an overload absorbing hydraulic chamber (13) and with an oil pressure sensing means (33) which senses a pressure of the hydraulic chamber (13), and when a load has been imposed on the mechanical press (1) at each of the die height positions (a,b,c,d,e,f), peak oil pressures (Pa,Pb,Pc,Pd,Pe,Pf) of the hydraulic chamber (13) sensed by the oil pressure sensing means (33) are taken as the values correlative to strain.

3. The method for obtaining calibration data of a mechanical press as set forth in claim 2, wherein in order to seek the reference die height positions (a)(f), values of reference peak oil pressures (Pa)(Pf) corresponding to the small load value (Fa) and the large load value (Ff) are preliminarily acquired, and die height positions when the oil pressure sensing means (33) has sensed the reference peak oil pressures (Pa)(Pf) with loads imposed on the mechanical press (1) are taken as the reference die height positions (a)(f).

4. A device for obtaining calibration data of a mechanical press by utilizing the fact that a load (F) of the mechanical press (1) is proportional to strain of the mechanical press (1) and a die height (H) set through a die height adjusting mechanism (20), the load (F) having a plurality of load values (Fa,Fb,Fc,Fd,Fe,Ff) and the die height (H) having a plurality of die height positions (a,b,c,d,e,f), wherein at least two reference die height positions (a)(f) where the load (F) comes to a small load value (Fa) and a large load value (Ff) are sought, and intermediate die height positions (b,c,d,e) corresponding to a plurality of intervening load values (Fb,Fc,Fd,Fe) between the small load value (Fa) and the large load value (Ff) are selected, the device comprising a sensing means (33) which senses values (Pa,Pb,Pc,Pd,Pe,Pf) correlative to strain and corresponding to the plurality of die height positions (a,b,c,d,e,f), a data inputting means (31), and a calibration data storing means (40), the calibration data storing means (40) storing relative relationships between the load values (Fa,Fb,Fc,Fd,Fe, Ff) corresponding to the die height positions (a,b,c,d, e,f) and the sensed values correlative to strain (Pa,Pb, Pc,Pd,Pe,Pf) as load displaying calibration data (FP).

5. The device for obtaining calibration data of a mechanical press as set forth in claim 4, wherein the mechanical press (1) is provided with an overload absorbing hydraulic chamber (13) and with a sensing means (33) which senses a pressure of the hydraulic chamber (13), and when a load has been imposed on the mechanical press (1) at each of the die height positions (a,b,c,d,e,f), peak oil pressures (Pa,Pb,Pc,Pd,Pe,Pf) of the hydraulic chamber (13) sensed by the sensing means (33) are taken as the values correlative to strain.

6. A load display device for a mechanical press comprising an overload absorbing hydraulic chamber (13) provided within a slide (4) of the mechanical press (1), a die height adjusting mechanism (20) arranged in the slide (4), an oil pressure sensing means (33) connected to the hydraulic chamber (13), a calculating device (35), and a display (36), there being preliminarily inputted to the calculating device (35), load displaying calibration data (FP) which has been obtained by utilizing the fact that a load (F) of the mechanical press (1) is proportional to a pressure (P) of the hydraulic chamber (13) and a die height (H) set through the die height adjusting mechanism (20), and is a relative relationship between the load (F) and the pressure (P), the calculating device (35) calculating the load (F) of the mechanical press (1) based on maximum oil pressure ($P_{MAX}$) sensed by the oil pressure sensing means (33) during a press working and the calibration data (FP), and the calculated load (F) being displayed by a display (36), the calculating device (35) comprising a calibration data storing means (40) which stores the calibration data (FP), storing means (44),(45) which store minimum oil pressure ($P_{MIN}$) sensed by the oil pressure sensing means (33) and the maximum oil pressure ($P_{MAX}$), respectively, a program command means (46) which commands a correcting calculation and a load calculation according to predetermined procedures, a preload pressure comparing means (47) which monitors variation of the minimum oil pressure ($P_{MIN}$), a correcting means (48) which corrects the calibration data (FP) in accordance with the variation, and a calculating means (49) which calculates the load (F) from the corrected calibration data (FP) and the maximum oil pressure ($P_{MAX}$).

* * * * *